US006668065B2

(12) United States Patent
Lee et al.

(10) Patent No.: US 6,668,065 B2
(45) Date of Patent: Dec. 23, 2003

(54) BONE-CONDUCTION TRANSDUCER AND BONE-CONDUCTION SPEAKER HEADSET THEREWITH

(75) Inventors: Sang Chul Lee, Kyeonggi-Do (KR); Bon Youn Koo, Seoul (KR)

(73) Assignee: Dowumitec Corporation, Incheon (KR)

( * ) Notice: Subject to any disclaimer, the term of this patent is extended or adjusted under 35 U.S.C. 154(b) by 0 days.

(21) Appl. No.: 10/257,372

(22) PCT Filed: Apr. 18, 2001

(86) PCT No.: PCT/KR01/00647

§ 371 (c)(1),
(2), (4) Date: Oct. 17, 2002

(87) PCT Pub. No.: WO01/80598

PCT Pub. Date: Oct. 25, 2001

(65) Prior Publication Data

US 2003/0048913 A1 Mar. 13, 2003

(30) Foreign Application Priority Data

Apr. 18, 2000 (KR) ..... 2000/20409

(51) Int. Cl.[7] ..... H04R 25/00
(52) U.S. Cl. ..... 381/380; 381/151
(58) Field of Search ..... 381/151, 326, 381/380, 374, 370

(56) References Cited

U.S. PATENT DOCUMENTS 2,143,130 A * 1/1939 Nicholides

FOREIGN PATENT DOCUMENTS

| | | | |
|---|---|---|---|
| GB | 2071961 | * | 9/1981 |
| WO | 0679965 A5 | | 5/1992 |
| WO | 0519621 A1 | | 12/1992 |
| WO | 2275149 | | 8/1994 |

* cited by examiner

*Primary Examiner*—Sinh Tran
(74) *Attorney, Agent, or Firm*—Bacon & Thomas

(57) ABSTRACT

Disclosed is a bone-conduction transducer comprising a plate-shaped yoke bent to form a pair of cut portions at both ends thereof; voice coils fitted to a center extension of the cut portions; a magnet and a plate of rectangular parallelepiped shape disposed between the voice coils; and a diaphragm minutely spaced from a lower part of the plate. The present invention constructed as above has an advantage of optimizing the bone-conduction transducer by fitting the voice coils to both the center extensions of the yoke to convert electrical signals into magnetic attractive and repulsive forces, and arranging the magnet and the plate between the voice coils. Further, the present invention has yet another advantage of enhancing the output efficiency, minimizing noise, and drastically reducing distortion, by improving functions of a base supporting the diaphragm as well as the diaphragms (made of a very low magnetic resistance material), whose weight is drastically reduced as compared to conventional diaphragms, in a manner of vibrating the diaphragm by virtue of the voice coils and the magnetic attractive and repulsive forces created according to variations in the current applied to the voice coils.

8 Claims, 3 Drawing Sheets

BONE-CONDUCTION TRANSDUCER AND BONE-CONDUCTION SPEAKER HEADSET THEREWITH

BACKGROUND OF THE INVENTION

The present invention generally relates to a bone-conduction speaker, and more particularly to a bone-conduction speaker, by which a user is capable of listening to sounds, by being abutted to a head to transmit vibrations to the skeleton structure.

It is widely known that, in contrast to general speakers, bone-conduction speakers have been developed in various types to sense audible sounds by converting electrical signals into vibrations and transmitting the converted vibrations to a cochlea.

In general, deaf people who can not hear air conductive sounds because of their handicaps in their middle and external ears, a pathway of the air conductive sounds, can use the bone-conduction speakers to perceive sound signals through bone vibrations, whereas people having normal hearing ability, who listen to sound signals by means of their auditory canal, can use also the bone-conduction speakers to feel audible sounds.

Therefore, the bone-conduction speakers can be variously used by the deaf people as well as the normal people. For example, the bone-conduction speakers can be used at a place where listening to sounds is difficult due to ambient noises, and further can be used for communications even under water or in a flame by being attached to a helmet worn for a special purpose of extinguishing a fire.

In view of the points mentioned above, the conventional bone-conduction speakers have been directed to reducing size, enhancing output efficiency and enlarging a frequency band. However, it has been very difficult to achieve both smaller size and higher output.

For instances, there has been much labor to increase the output efficiency and enlarge the frequency band by enlarging the size of a magnet and a transducer and increasing the number of turns of a voice coil. However, this approach has been found to have a disadvantage of increasing the entire size of outer diameter. On the contrary, if the size of outer diameter is minimized, it would bring about a disadvantage of decreasing the output efficiency, thereby failing to accomplish the reduction in size in accordance with optimization of the speaker.

SUMMARY OF THE INVENTION

It is, therefore, an object of the present invention to provide a bone-conduction speaker, which can minimize and optimize the size of a transducer comprised in a bone-conduction speaker, enhance output efficiency and enlarge a frequency band as well.

To achieve the above object, there is provided a bone-conduction transducer comprising a plate-shaped yoke formed by cutting a pair of portions at both ends thereof to form three extensions and bending the three extensions; voice coils each fitted to a center extension among the three extensions; a magnet and a plate of rectangular parallelepiped shape disposed between the voice coils; and a diaphragm minutely spaced from a lower part of the plate.

The present invention constructed as above has an advantage of optimizing the bone-conduction transducer by fitting the voice coils to both of the center extensions of the yoke to convert electrical signals into magnetic attractive and repulsive forces, and arranging the magnet and the plate between the voice coils. Further, the present invention has yet another advantage of enhancing the output efficiency, minimizing noise, and drastically reducing distortion, by improving functions of a damper (base) supporting the diaphragm and the diaphragm (made of a very low magnetic resistance material), whose weight is drastically reduced as compared to conventional diaphragms, in a manner of vibrating the diaphragm by virtue of the voice coils and the magnetic attractive and repulsive forces created according to variations in the current applied to the voice coils.

BRIEF DESCRIPTION OF THE DRAWINGS

Further objects and advantages of the invention can be more fully understood from the following detailed description taken in conjunction with the accompanying drawings, in which.

DETAILED DESCRIPTION OF THE PREFERRED EMBODIMENT

Figure 1:
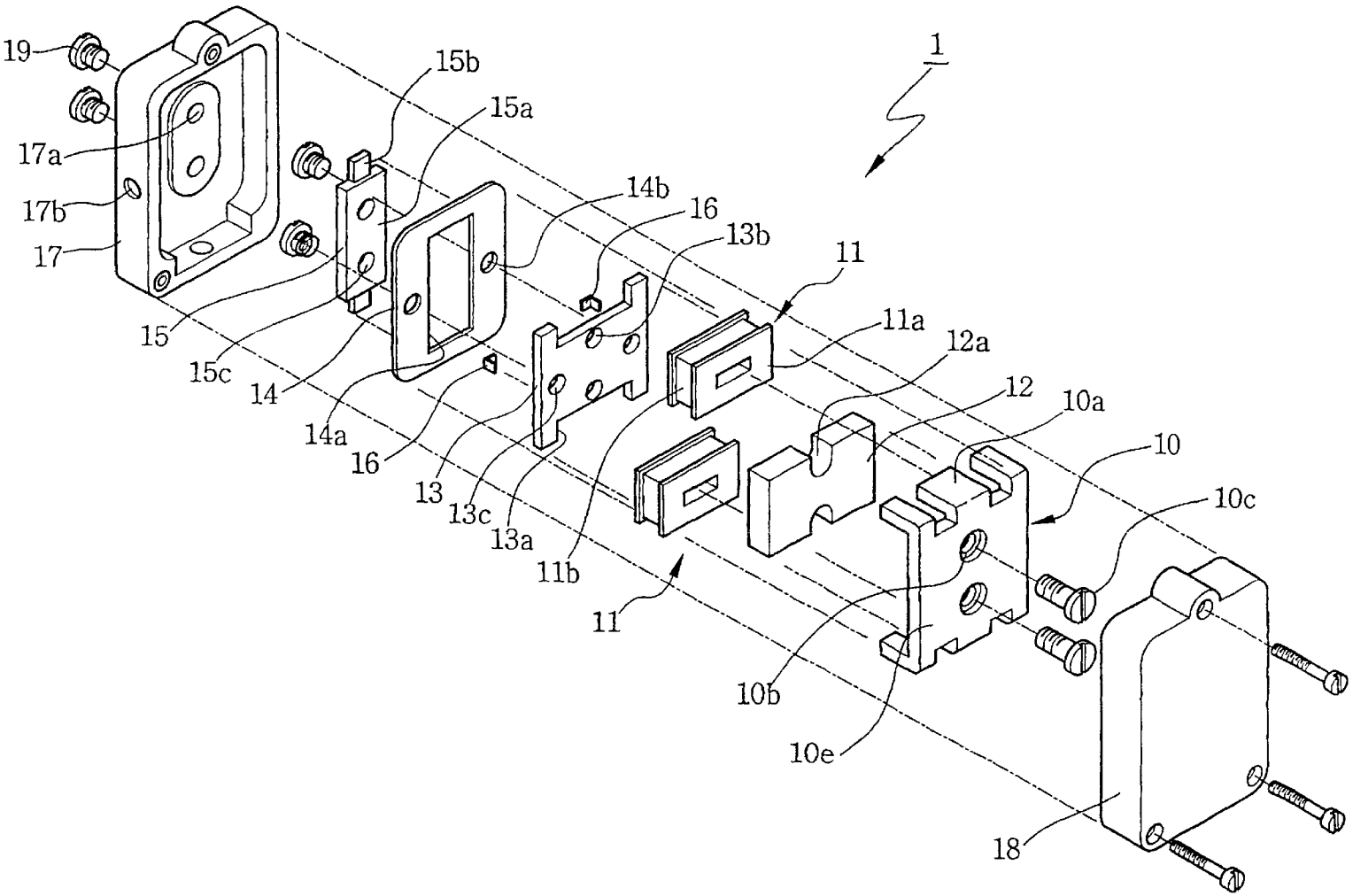
FIG. 1 is an exploded cross view of a transducer comprised in a bone-conduction speaker according to the present invention.
Figure 2:
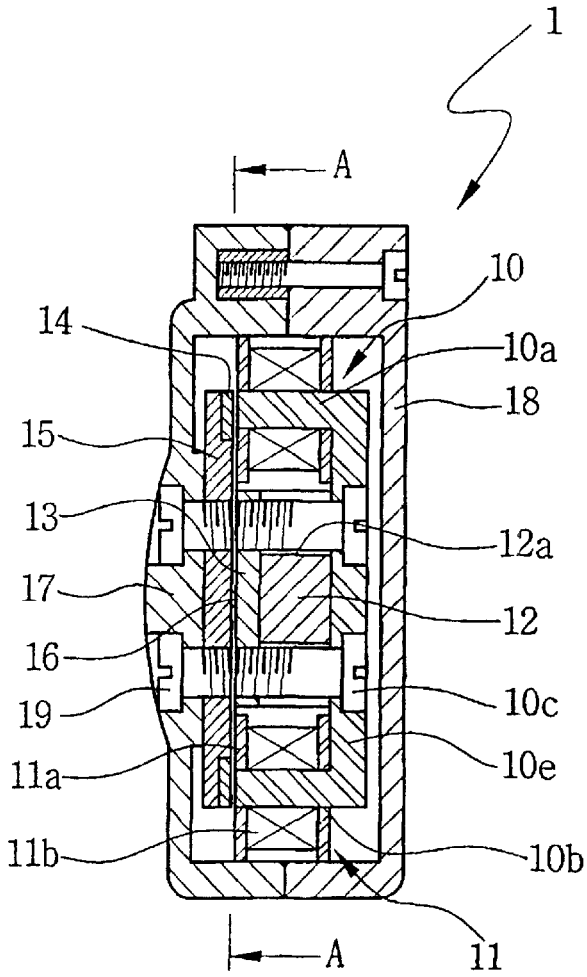
FIG. 2 is a sectional view of the assembled transducer of FIG. 2.

The present invention will now be described in connection with preferred embodiments with reference to the accompanying drawings. FIG. 1 is an exploded cross view of a transducer comprised in a bone-conduction speaker according to the present invention, and FIG. 2 is a sectional view of the assembled transducer of FIG. 2.

Referring to the drawings, the transducer according to the present invention comprises: a yoke 10 having three extensions formed at both ends thereof, respectively; voice coils 11, each being fitted to a center extension of both the ends of the yoke 10; a magnet 12 disposed between the voice coils 11 and the yoke 10; a plate 13 facing a left surface of the magnet 12; a base 14 minutely spaced from a left side of the plate 13; and a diaphragm 15 coupled to the base 14.

The yoke 10 has a plate-shaped body 10*e* of a predetermined thickness and extensions 10*a* which are formed by inwardly cutting two portions by a predetermined length at both ends of the body 10*e*, respectively, and bending the extended parts. Accordingly, the yoke 10 becomes U-shaped. Tapped holes 10*b* are formed through the body 10*e* in a thickness direction to be coupled to the plate 13 with screws. Furthermore, each voice coil 11 is fitted to the center extension among the three extensions 10*a* of the yoke 10.

Each of the voice coils includes a reel-shaped bobbin, which is penetrated at a central portion thereof, and a coil to have a predetermined number of turns at a peripheral line of the bobbin 11*a*. The voice coils create a magnetic change according to variations in the current applied to the voice coils and vibrate the diaphragm 15 due to the magnetic change so as to reproduce the voice.

The magnet 12 is arranged between the vertically opposite voice coils 11 but is spaced at a predetermined interval from the respective voice coils. The magnet 12 is of a rectangular parallelepiped and has reentrant holes 12*a* formed at a lower surface and an upper surface facing the lower surface, through which the screws 10*c* pass to fasten the yoke 10 to the plate 13. In a state that a right surface of the magnet 12 is contacted with a lower surface (left surface) of the yoke 10, thickness of the magnet 12 should be appropriately maintained so that the left surface of the magnet 12 is positioned lower than the extensions of the yoke 10, thereby minimizing the overall thickness of the transducer.

The plate 13 has cut portions 13*a* formed by removing specific portions from both ends of the plate as shown in the drawings, and allows the cut portions 13*a* to accommodate the vertically opposite surfaces of the voice coils 11, accordingly serving to minimizing the overall size of the transducer. The plate 13 has also four throughholes. Among the four throughholes, two throughholes 13*b* on vertically opposite sides correspond to the tapped holes 10*b* formed through the yoke 10 to clamp the plate 13 to the magnet 12 positioned between the yoke 10 and the plate with the screws 10*c*. The rest throughholes 13*c* on horizontally opposite sides secures the plate 13 to the base 14. As best drawn in FIG. 2, once the components are all assembled, the lower surface (left surface) of the extensions 10*a* of the yoke 10, the left surface of the bobbin 11*a* of the voice coils 11 and the left surface of the plate 13 are positioned at the same level.

That is, when the voice coils 11, the magnet 12 and the plate 13 are secured to with one another, they are lower in position than surfaces of free ends other than the center extension among the extensions 10*a* of the yoke 10.

Figure 3:
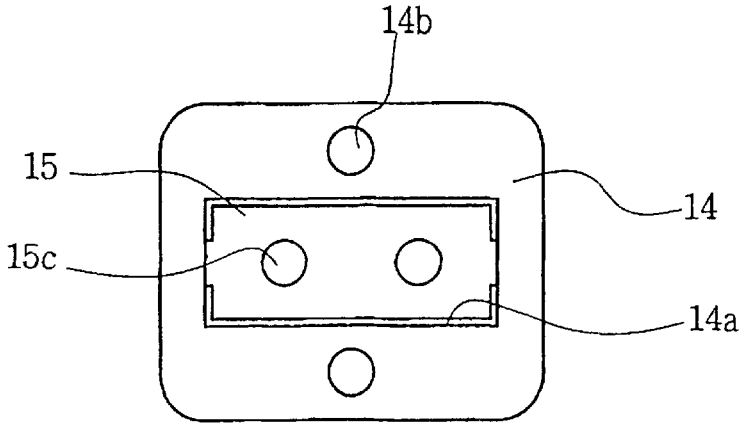
FIG. 3 is a plan view of the transducer in section taken along the line A-A of FIG. 2.

According to the present invention, the base 14 and the diaphragm 15 are arranged at the left side of the plate 13. As mentioned above, the plate 13 is spaced at a minute interval from the base 14 and the base 14 is spaced at a minute interval from the diaphragm 15. As depicted in FIG. 3, the base 14 has a square hole 14*a* of predetermined size formed by penetrating a central portion of the base 14, finally becoming square ring-shaped. The base further has throughbores 14*b* formed at both opposite surfaces in a width direction thereof to correspond to the throughholes 13*c* at the plate. The diaphragm 15 is intercalated into the square hole 14*a* of the base 14.

The diaphragm 15 has an insert section 15*a*, which is inserted into the square hole 14*a* of the base 14, wherein the insert section 15*a* is minutely spaced from surfaces of the square hole 14 at both horizontally opposite ends thereof but is closely fixed to surfaces of the square hole 14*a* at both vertically opposite ends thereof, whereby a right surface of the insert section 15*a* is positioned at the same level as a right upper surface of the base 14. The insert section 15*a* has a pair of protrusions 15*b* longitudinally extended therefrom, which are not beyond the both vertical ends of the base 14. The protrusions 15*b* come in contact with the base 14 in face-to-face relations when being secured to the base 14.

The insert section 15*a* has a pair of perforated holes 15*c* through a central portion thereof. The perforated holes 15*c* are used to fasten a transducer 1 placed within a housing, which will be explained herein below, to the housing by means of screws.

Here, the base 14 and the diaphragm 15 are separated from each other and thus have to be coupled to each other through the above process. However, they can be also integrally formed as a unit.

The reference numeral 16 denotes spacer members for leaving a minute space between the plate 13 and the diaphragm 15. Each spacer member 16 is formed by bending a sheet at a right angle, wherein one bent surface is disposed between the plate 13 and the diaphragm 15 while other bent surface is contacted with a lateral side of the plate 13, whereby the spacer members 16 are arranged at horizontally opposite sides of the plate 13. Besides, a weight (not shown) having appropriate size and weight may be attached to a bottom of the yoke 10 to enlarge the frequency band.

The housing 17 and the diaphragm 15 are fastened to each other with screws 19. At this time, vibrations of the diaphragm 15 are transmitted to a bone-conduction transducer through the housing 17 since one lateral surface of the diaphragm 15 is contacted with the housing 17.

The bone-conduction transducer 1 constructed as above creates a magnetic field at the voice coils 11 due to the voice current (external signals) applied from the outside. To be specific, the magnetism is changed at a place between the upper voice coil 11 and the right and left extensions 10*a* adjacent to the upper voice coil 11, and further the magnetism is changed between the lower voice coil 11 and the right and left extensions 10*a* adjacent to the lower voice coil 11. In addition, magnetic density gaps are formed at four spots between the right and left free ends of both the upper and lower extensions of the yoke 10 and the right surface of the base 14 on which the diaphragm 15 is arranged due to an interaction of the magnet with the extensions (four spots in four directions in the drawings).

The magnetic change generated between the voice coils 11 and the extensions and the magnetic density gaps formed between the extensions 10*a* and the base 14 cause the diaphragm 15 to vibrate due to the magnetic attractive and repulsive forces created by the electrical signals flowed through the voice coils 11, thereby allowing a user to perceive audible sounds through the bone conduction.

The transducer is built into the housing as shown in the drawings. The housings are separated into two parts 17 and 18.

Figure 4:
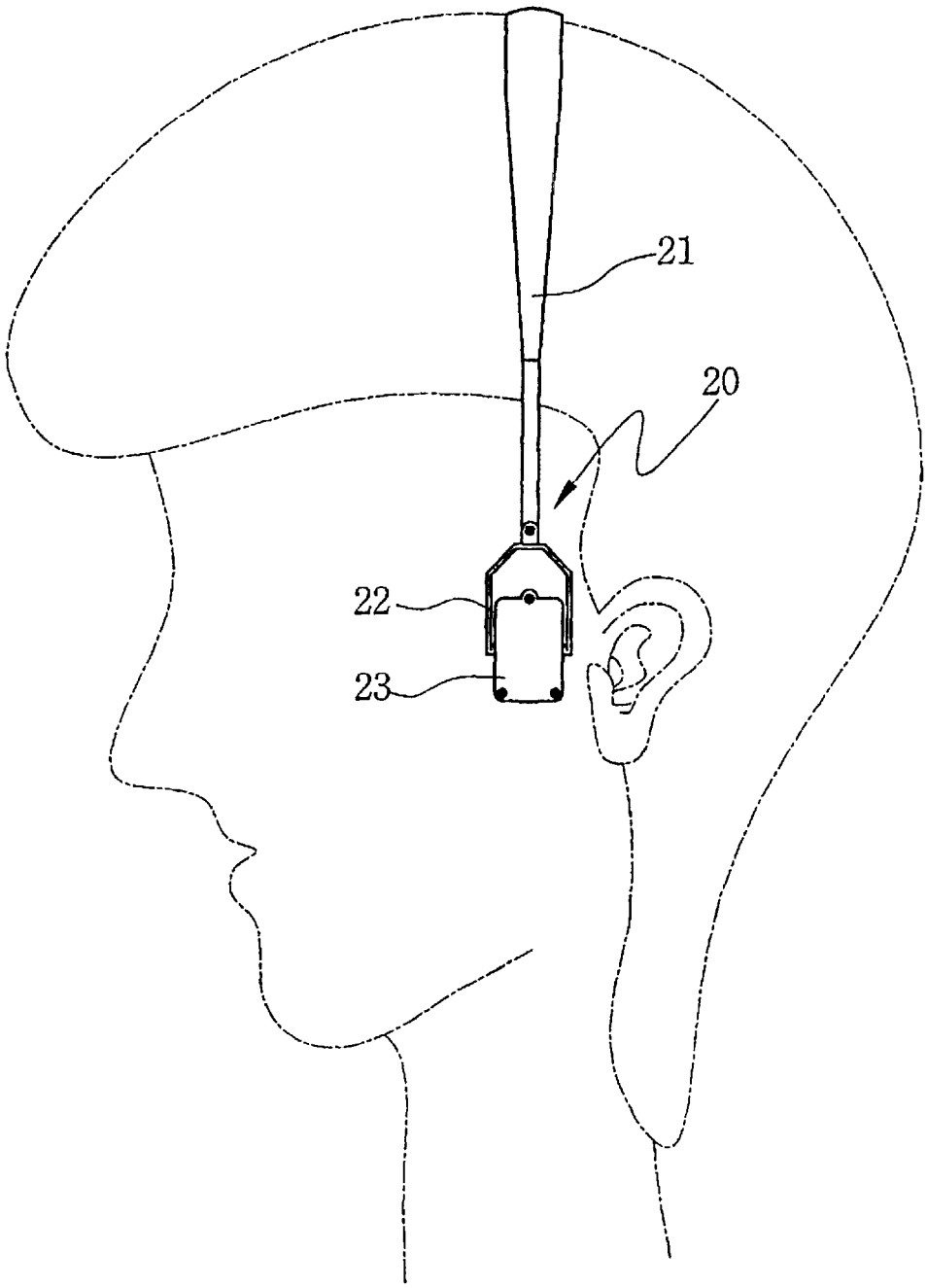
FIG. 4 is a side view of a headset according to the present invention.

An assembly comprising the transducer 1 surrounded by the housing 17 and 18 can be realized into a shape of headset 20 as drawn in FIG. 4.

The headset 20 is manufactured by coupling links 22 at both ends of a headband 21 with hinges and pivotally coupling each link 22 at a hole 17*b* formed through a lateral side of the housing 17 having the transducer 1 therewithin. As a result, the angle of the assembly 23 with the transducer is automatically adjustable to a lateral side of a head by virtue of elasticity of the headband 21, and adjustable back and forth by virtue of the hinge-coupling between the headband 21 and the links 22.

As stated above, the present invention has an advantage of minimizing the size by bending the yoke at the right angle to form the extensions at the perpendicularly bent surface, fitting the pair of voice coils to the central extensions and arranging the magnet between the voice coils, and further another advantage of enlarging the frequency band, enhancing the output efficiency, and minimizing the noise as well as drastically reducing the distortion by forming the magnetic density gaps at four spots between the yoke and the plate, maintaining the base made of a light material in its best condition and vibrating the diaphragm due to the magnetic attractive and repulsive forces created by the electrical signals flowed through the voice coils.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A bone-conduction transducer comprising:

a yoke having a plate-shaped body, at least two extensions arranged at one end of the body in a direction orthogonal to the body and at least two extensions arranged at the other end of the body in a direction orthogonal to the body;

a pair of voice coils, one voice coil being disposed at a predetermined interval between the extensions arranged at the one end of the body and the other voice coil being disposed at a predetermined interval between the extensions arranged at the other end of the body;

a magnet being disposed between the pair of voice coils but spaced at a predetermined interval from the opposite surfaces of the voice coils, respectively;

a plate contacting with one surface of the magnet opposite to other surface of the magnet toward the yoke; and diaphragm arranged at one surface of the plate opposite to other surface of the plate contacting with the magnet, wherein external signals generated in an interaction between the pair of voice coils and the extensions formed at the one end and the other end of the yoke create a magnetic change, which causes magnetic density gaps to be formed in an interaction between the diaphragm and the extensions formed at the one end and the other end of the yoke through the magnet, thereby allowing a user to sense the external signals through vibrations transmitted to the diaphragm.

2. The bone-conduction transducer of claim 1, further comprising spacer members disposed between the plate and the diaphragm to maintain a minute space.

3. The bone-conduction transducer of claim 1, further comprising a base arranged between the plate and the diaphragm, wherein the base has a square hole within which the diaphragm is accommodated, with a surface of the diaphragm facing the plate being positioned at the same level as that of the base.

4. The bone-conduction transducer of claim 3, wherein the diaphragm is minutely spaced from surfaces of the square hole at horizontally opposite ends thereof.

5. The bone-conduction transducer of claim 3, wherein the plate and the base are fastened to each other with screws.

6. The bone-conduction transducer of claim 1, wherein the magnet is constrictively fixed between the yoke and the plate fastened with screws.

7. The bone-conduction transducer of claim 1, wherein the assembled magnet and plate are lower in position than surfaces of free ends of the extensions of the yoke.

8. A bone-conduction speaker headset comprising:

a bone-conduction transducer assembly including a yoke having a plate-shaped body, at least two extensions arranged at one end of the body in a direction orthogonal to the body and at least two extensions arranged at the other end of the body in a direction orthogonal to the body, a pair of voice coils, one voice coil being disposed at a predetermined interval between the extensions arranged at the one end of the body and the other voice coil being disposed at a predetermined interval between the extensions arranged at the other end of the body, a magnet being disposed between the pair of voice coils but spaced at a predetermined interval from the opposite surfaces of the voice coils, respectively, a plate arranged at one surface of the magnet opposite to other surface of the magnet toward the yoke, and a diaphragm arranged at one surface of the plate opposite to other surface of the plate contacting with the magnet;

a pair of housings, each housing accommodating the bone-conduction transducer assembly for the diaphragm to be contacted with an inner surface of the housing;

a headband having an elasticity and being put on a user's head; and a pair of links for pivotally coupling the pair of housings to both ends of the headband, respectively, each link being pivotally rotatable around the headband and the housing.

* * * * *